US009562449B2

(12) United States Patent
Gao et al.

(10) Patent No.: US 9,562,449 B2
(45) Date of Patent: Feb. 7, 2017

(54) OIL DRAIN STRUCTURE FOR OIL MIST SEPARATOR

(71) Applicant: MAHLE FILTER SYSTEMS JAPAN CORPORATION, Tokyo (JP)

(72) Inventors: Zhigang Gao, Shanghai-shi (CN); Terumoto Mochizuki, Saitama (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 0 days.

(21) Appl. No.: 14/366,819

(22) PCT Filed: Dec. 10, 2012

(86) PCT No.: PCT/JP2012/081907
§ 371 (c)(1),
(2) Date: Jun. 19, 2014

(87) PCT Pub. No.: WO2013/094452
PCT Pub. Date: Jun. 27, 2013

(65) Prior Publication Data

US 2014/0345580 A1 Nov. 27, 2014

(30) Foreign Application Priority Data

Dec. 20, 2011 (JP) ..... 2011-278667

(51) Int. Cl.
*F02B 25/06* (2006.01)
*F01M 13/04* (2006.01)
(Continued)

(52) U.S. Cl.
CPC ..... *F01M 13/04* (2013.01); *F01M 13/022* (2013.01); *F01M 13/023* (2013.01);
(Continued)

(58) Field of Classification Search
CPC .... F01M 13/04; F01M 13/022; F01M 13/023; F01M 13/0416; F02M 25/06
(Continued)

(56) References Cited

U.S. PATENT DOCUMENTS 4,709,722 A * 12/1987 Knapp ..... F16K 15/044 137/515.5
6,021,812 A * 2/2000 Iwamoto et al. ..... 137/625.3
(Continued)

FOREIGN PATENT DOCUMENTS

JP 59-7212 U 1/1984
JP 62-18315 U 2/1987
(Continued)

*Primary Examiner* — Lindsay Low
*Assistant Examiner* — Charles Brauch
(74) *Attorney, Agent, or Firm* — Foley & Lardner LLP

(57) ABSTRACT

An oil drain structure for an oil mist separator including a drain pipe extending from the oil mist separator into the internal combustion engine, the drain pipe having an oil discharge hole extending through a lower end portion of the drain pipe along an axial direction of the drain pipe, and a check valve including a valve body disposed below the lower end portion of the drain pipe, the valve body acting to open and close the oil discharge hole from a side of a lower surface of the lower end portion of the drain pipe, a valve head portion fitted into the drain pipe with a fine clearance as an orifice and being moveable in the axial direction of the drain pipe, and a stem portion extending through the oil discharge hole to connect the valve body and the valve head portion with each other.

9 Claims, 7 Drawing Sheets

(51) Int. Cl.
*F01M 13/02* (2006.01)
*F02M 25/06* (2016.01)

(52) U.S. Cl.
CPC . *F01M 13/0416* (2013.01); *F01M 2013/0433* (2013.01); *F01M 2013/0494* (2013.01); *F02M 25/06* (2013.01)

(58) Field of Classification Search
USPC ..... 123/572
See application file for complete search history.

(56) References Cited

U.S. PATENT DOCUMENTS

| | | | | |
|---|---|---|---|---|
| 7,007,682 | B2 | 3/2006 | Takahashi et al. | |
| 2009/0039305 | A1* | 2/2009 | Shakagori et al. | 251/306 |
| 2010/0206917 | A1* | 8/2010 | Tudor et al. | 222/559 |
| 2011/0180051 | A1* | 7/2011 | Schwandt et al. | 123/573 |

FOREIGN PATENT DOCUMENTS

| | | | |
|---|---|---|---|
| JP | 1-148010 | U | 10/1989 |
| JP | 07-259530 | A | 10/1995 |
| JP | 09-290651 | A | 11/1997 |
| JP | 2003-013723 | A | 1/2003 |
| JP | 4294949 | B2 | 7/2009 |
| JP | 2011-047353 | A | 3/2011 |

* cited by examiner

OIL DRAIN STRUCTURE FOR OIL MIST SEPARATOR

TECHNICAL FIELD

The present invention relates to an oil drain structure of an oil mist separator for treating a blow-by gas of an internal combustion engine.

BACKGROUND ART

As is well known, an oil mist separator that separates and removes an oil mist present in a blow-by gas blowing from a combustion chamber into a crankcase is provided in a head cover of an internal combustion engine. The oil mist separator is configured to separate the oil mist from the blow-by gas using a collision plate or the like, and supply the gas from which the oil mist is separated to an intake system. The oil mist separator is also configured to return the oil separated to an interior of the internal combustion engine through a drain pipe.

Here, when a pressure difference between the interior of the engine and an interior of the oil mist separator which undergoes an intake negative pressure is increased, there is a fear that the oil may be flowed back from the interior of the engine into the interior of the oil mist separator through the drain pipe or may be brought or blown into an intake system by entrainment on the blow-by gas.

As a countermeasure against the above possibility, Patent Literature 1 discloses an oil separator provided with a check valve for opening and closing a lower end opening, that is, an oil discharge hole of the drain pipe. The check valve is detachably mounted to the lower end of the drain pipe through a plurality of arm members that are slidably engaged with a plurality of guide members provided on an outer periphery of the drain pipe.

Patent Literature 1 recites the following configuration. When a pressure difference between the interior of the oil mist separator and the interior of the engine is small, for instance, at a time at which the engine is stopped, the check valve is pushed down by the weight of the oil so that the oil discharge hole is opened. On the other hand, during an operation of the internal combustion engine, the check valve is sucked by the intake negative pressure so that the oil discharge hole is closed to thereby prevent a backflow of the oil. Also, when the oil is accumulated in the drain pipe, the check valve is pushed down by a head pressure of the oil so that the oil is drained, and after that, the check valve is sucked again by the negative pressure so that the oil discharge hole is closed.

However, the check valve of Patent Literature 1 is not provided with a member operative in response to the pressure difference other than a disc-shaped valve body that closes the oil discharge hole formed at the lower end of the drain pipe from an outside of the drain pipe, namely, a lower end side of the drain pipe, so that the valve body itself is allowed to upwardly move in response to the pressure difference. Accordingly, when a clearance between the check valve in an open state thereof and the lower end of the drain pipe is large, or when the intake negative pressure exerted to the interior of the oil mist separator is small; i.e., when the pressure difference between the interior of the oil mist separator and the interior of the engine is small, there is a fear that the check valve is not sucked and kept in the open state due to its own weight.

Further, in a case where the own weight of the check valve is increased due to adhesion of an oil droplet to the valve body, there is a fear that the opening operation of the check valve and the closing operation thereof become unstable.

It is an object of the present invention to provide an oil drain structure of an oil mist separator which includes a check valve adapted to ensure desired opening and closing operations thereof due to an own weight of accumulated oil and a pressure difference between an interior of the oil mist separator and an interior of the engine.

CITATION LIST

Patent Literrature

Patent Literature 1: Japanese Patent No. 4294949

SUMMARY OF INVENTION

In one aspect of the present invention, there is provided an oil drain structure of an oil mist separator that is configured to separate an oil mist from a blow-by gas of an internal combustion engine, and discharge the separated oil mist into an interior of the internal combustion engine through a drain pipe while supplying the gas from which the oil mist is separated to an intake system, the oil drain structure including:

a check valve configured to open and close an oil discharge hole formed in a lower end portion of the drain pipe so as to extend through the lower end portion along an axial direction of the drain pipe, the check valve including:

a valve body disposed below the lower end portion of the drain pipe, the valve body acting to open and close the oil discharge hole from a side of a lower end surface of the lower end portion of the drain pipe;

a valve head portion fitted into the drain pipe with a fine clearance as an orifice, the valve head portion being moveable in the axial direction of the drain pipe; and a stem portion extending through the oil discharge hole to connect the valve body and the valve head portion with each other.

In one preferred embodiment of the present invention, the valve head portion has a spherical shape so as to suppress a change in the fine clearance as the orifice even when the valve head portion is inclined in the drain pipe.

In a further preferred embodiment of the present invention, the drain pipe has a constant cross-sectional shape at least in a range in which the valve head portion is moveable.

In the check valve of the present invention, for example, when a negative pressure in the intake system during an operation of the engine is exerted on the interior of the oil mist separator in a state in which the valve body is downwardly spaced apart from a lower end opening of the oil discharge hole and the check valve is in the open state, the valve head portion disposed in the drain pipe with the fine clearance as the orifice is upwardly sucked by the intake negative pressure so that the check valve can be reliably operated in a closing direction of the check valve.

That is, since there is the fine clearance between an inner wall surface of the drain pipe wall and the valve head, the oil separated by the oil mist separator can flow through the fine clearance. On the other hand, the fine clearance serves as a kind of orifice with respect to a flow (backflow) of the blow-by gas flowed through the oil discharge hole due to a pressure difference between a pressure in an interior of the engine and a negative pressure in an interior of the oil mist separator, so that a pressure difference is generated between an upper side and a lower side of the valve head portion within the drain pipe. The valve head portion is surely biased upward due to the pressure difference, and the valve body connected with the valve head portion through the stem portion closes the oil discharge hole from a side of a lower end surface of the drain pipe.

Incidentally, since normally, a cross-sectional area of the passage formed by the fine clearance is narrowed by an oil droplet or an oil film, the check valve is operated to close the oil discharge hole almost before the blow-by gas flows back.

Further, once the oil discharge hole is closed, the valve body closing the oil discharge hole also undergoes the pressure difference, so that the check valve is held in a closed state.

On the other hand, when an oil is accumulated in the drain pipe in the closed state of the check valve and an oil level height is raised, a gravitational force of the oil downwardly acts on the check valve to move the check valve downwardly so that the valve body opens the oil discharge hole. As a result, the oil in the drain pipe is discharged. Further, after the oil is discharged, the check valve is moved to the closed state again due to the pressure difference. Accordingly, during an operation of the internal combustion engine, a movement of the check valve between the closed state in which the oil is accumulated until reaching an appropriate amount and the open state in which the oil is discharged is repeated so that an excessive accumulation of the oil in the drain pipe can be suppressed and the check valve can be substantially held in the closing state.

In one embodiment of the present invention, a density of the valve head portion is lower than a density of the oil so that the valve head portion serves as a float in the oil accumulated in the drain pipe. Accordingly, in this case, a buoyant force that is generated by the valve head portion in the oil acts as a force that biases the check valve upwardly (in a closing direction) in cooperation with the above-described pressure difference.

Further, even in a case where the density of the valve head portion is higher than the density of the oil, if the valve head portion is in the oil, the corresponding buoyant force is generated to thereby cancel a part of a force that biases the check valve downwardly (in the opening direction) due to the own weight.

As described above, the check valve including a valve head portion and a valve body which are connected to each other through a stem portion is assembled to the drain pipe in a state in which the stem portion penetrates the oil discharge hole. In a preferred embodiment of the present invention, one of the valve head portion and the valve body of the check valve is made of an elastically deformable rubber and the other thereof is made of a synthetic resin, and the rubber portion is insertedly assembled in the oil discharge hole while being deformed.

In addition, when an oil droplet is adhered to the valve body disposed below the oil discharge hole, the force acting on the check valve downwardly (in the opening direction) due to gravitational force of the check valve is increased so that a desired closing operation of the check valve based on the pressure difference might be disturbed. In a preferred embodiment, a lower end surface of the check valve has a downwardly projecting conical surface or a downwardly projecting curved surface. With this configuration, it is possible to promote drop of an oil film.

Thus, the oil drain structure of an oil mist separator according to the present invention has a simple construction but can surely suppress a backflow of the blow-by gas which flows from the interior of the engine into the oil mist separator through the drain pipe. Accordingly, it is possible to prevent the blow-by gas from bringing or blowing the oil to an intake system.

DESCRIPTION OF EMBODIMENTS

Figure 1:
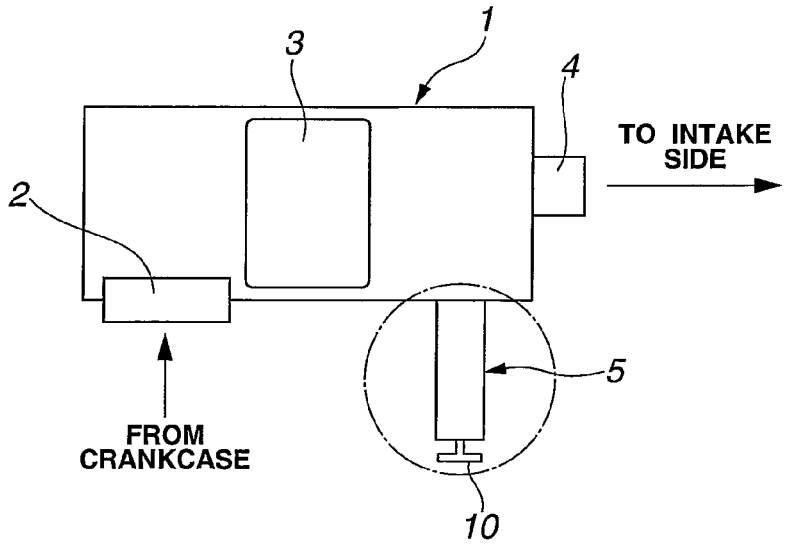
FIG. 1 is a schematic diagram showing an oil mist separator to which a check valve according to a first embodiment of the present invention is applicable.

In the following, embodiments of the present invention will be explained by referring to accompanying drawings. As shown in FIG. 1, an oil mist separator 1 is disposed inside a head cover mounted to an upper portion of a cylinder head of an internal combustion engine. The oil mist separator 1 includes a gas introduction portion 2 into which a blow-by gas is introduced from a crank chamber, an oil mist separator portion 3 in which an oil mist is separated from the blow-by gas introduced, a gas outlet 4 to supply the gas from which the oil mist is separated to an intake system, and a drain pipe 5 to discharge the separated oil into an interior of the cylinder head of the internal combustion engine. In the oil mist separator portion 3, gas-liquid separation is carried out, for example, by colliding the blow-by gas against a collision plate. The drain pipe 5 extends substantially vertically downward from a lower wall portion of the oil mist separator 1 in a vehicle-mounted state. A lower end of the drain pipe 5 is open into the interior of the cylinder head such that oil in the oil mist separator 1 is dropped into the cylinder head. A check valve 10 is mounted to a lower end portion of the drain pipe 5.

Figure 2:
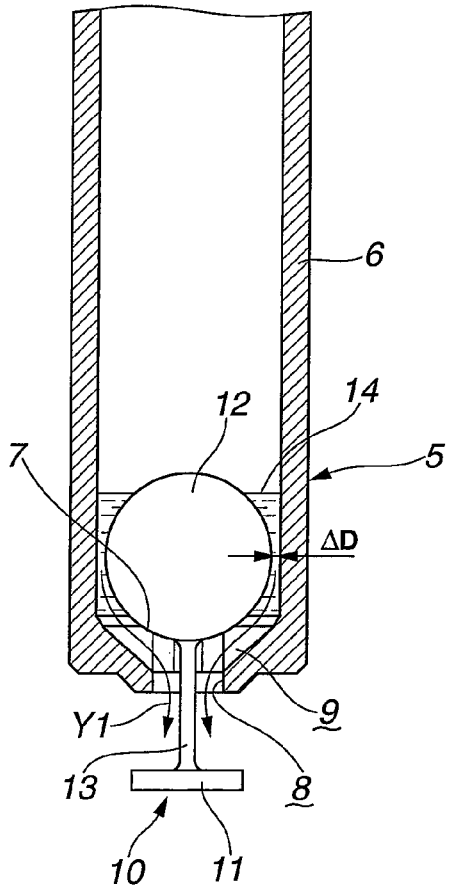
FIG. 2 is a sectional view of the oil mist separator, showing a lower end portion of a drain pipe in a valve open state in which the check valve is in a lowermost position.
Figure 3:
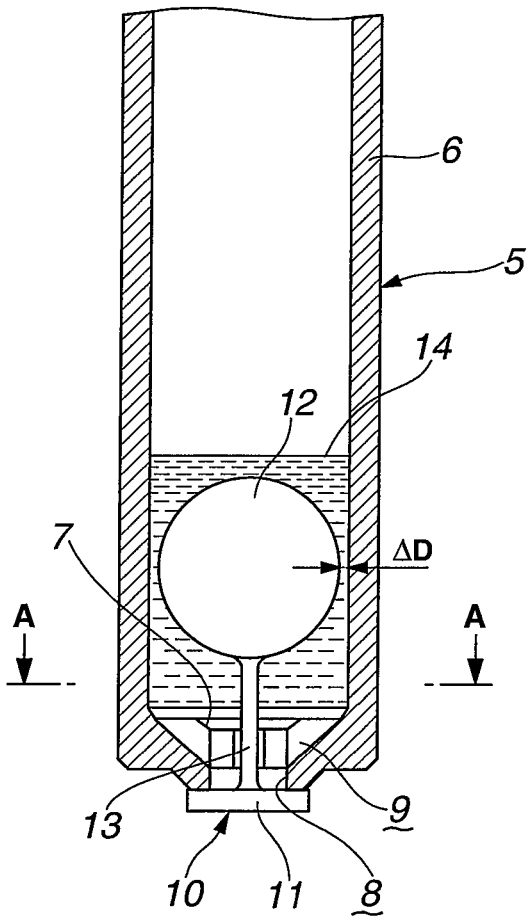
FIG. 3 is a sectional view of the oil mist separator, showing the lower end portion of the drain pipe in a valve closed state in which the check valve is in an uppermost position.
Figure 4:
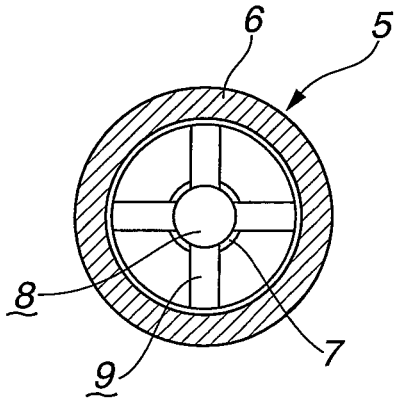
FIG. 4 is a sectional view taken along line A-A shown in FIG. 3.

Next, a drain structure including drain pipe 5 and check valve 10 which is an essential part of the embodiment is explained by referring to FIG. 2 to FIG. 5. FIG. 2 is a sectional view showing a valve open state in which the check valve 10 upwardly and downwardly moveable is in a lowermost position. FIG. 3 is a sectional view showing a valve closed state in which the check valve 10 is in an uppermost position. FIG. 4 is a sectional view taken along line A-A shown in FIG. 3, showing the lower end portion of the drain pipe 5.

The drain pipe 5 is made of a synthetic resin material and formed integrally with at least a part of the oil mist separator 1. The drain pipe 5 includes a cylindrical tubular portion 6 as a main body which downwardly extends from a lower wall portion of the oil mist separator 1. A seat portion 7 is disposed inside the lower end portion of the drain pipe 5. The seat portion 7 defines a generally conical surface downwardly projecting. Formed at the center of the seat portion 7 is an oil discharge hole 8 having a diameter smaller than an inner diameter of the tubular portion 6 and extends through the center of the seat portion 7 along an axial direction the drain pipe 5.

Further, four auxiliary oil discharge passages 9 are formed in the seat portion 7 located on a periphery of the oil discharge hole 8, and extend in a radial direction of the seat portion 7. The auxiliary oil discharge passages 9 are arranged at equivalent intervals in a circumferential direction of the seat portion 7. Each of the auxiliary oil discharge passages 9 is formed into a slit shape extending in the radial direction, so that the seat portion 7 is divided into substantially four arcuate portions. As shown in FIG. 2, in a state in which a valve head portion 12 of the check valve 10 as described later is seated on the seat portion 7, the oil accumulated in the drain pipe 5 can be discharged from the oil discharge hole 8 through the auxiliary oil discharge passages 9.

The check valve 10 includes a disc-shaped valve body 11 disposed below the lower end portion of the drain pipe 5, a valve head portion 12 fitted into the tubular portion 6 of the drain pipe 5 with a fine clearance AD that serves as an orifice, and a rod-shaped stem portion 13 connecting the valve body 11 and the valve head portion 12 with each other. The valve head portion 12 is moveable in the axial direction of the drain pipe 5 by the presence of the fine clearance ΔD. The stem portion 13 has a diameter smaller than that of the oil discharge hole 8, and extends through the oil discharge hole 8 to be also moveable in the axial direction of the drain pipe 5. Accordingly, the check valve 10 as a whole is moveable in the axial direction of the drain pipe 5, that is, in upward and downward directions by a predetermined amount. The valve body 11 located at a lower end of the check valve 10 is configured to close and seal an opening at a lower end of the oil discharge hole 8 when the check valve 10 is in the closed state shown in FIG. 5(B) in which the check valve 10 is in the uppermost position in a vertical direction, and downwardly displace to be spaced apart from the oil discharge hole 8 and open the oil discharge hole 8 in accordance with a downward movement of the check valve 10.

The valve head portion 12 is formed into a spherical shape having a predetermined radius. In the present embodiment, the valve head portion 12 has a density set to be smaller than that of the oil in order to serve as a float in the oil. For instance, the valve head portion 12 may be made of a synthetic resin material and formed into a hollow shape. The radius of the valve head portion 12 is set to be shorter than an inner radius of the tubular portion 6 by an amount of the fine clearance ΔD. Further, as shown in FIG. 2, in the valve open state in which the check valve 10 is located in the lowermost position, the valve head portion 12 is configured to seat on an upper surface of the seat portion 7 provided along a peripheral edge of the oil discharge hole 8 at the lower end of the drain pipe 5. In the valve open state, as indicated by arrow Y1 shown in FIG. 2, the oil accumulated in the drain pipe 5 is downwardly discharged into the interior of the engine through the fine clearance ΔD between the valve head portion 12 and the tubular portion 6, and then through the auxiliary oil discharge passages 9.

The fine clearance ΔD is set to be small enough to retain a pressure difference between an upper side and a lower side of the valve head portion 12 fitted to the tubular portion 6. For instance, the fine clearance ΔD may be set to be equal to or smaller than 1/10 of the radius of the drain pipe 5, specifically, equal to or smaller than 1 mm. The tubular portion 6 is formed into a simple cylindrical shape to define a passage having a constant cross-sectional area by the tubular portion 6 at least in a range in which the valve head portion 12 moves. Therefore, regardless of the upper and lower positions of the valve head portion 12, the fine clearance AD can be given at a constant value.

Next, forces that act on the check valve 10 and an operation of the check valve 10 will be explained by referring to FIG. 5. Main forces that are exerted on the check valve 10 includes a downward force F1 due to an own weight of the check valve 10, a downward force F2 due to gravitational force of the oil accumulated in the drain pipe 5, an upward force F3 constituted of a buoyant force that is exerted from the oil accumulated in the drain pipe 5 primarily onto the valve head portion 12, and an upward force F4 that is exerted on the valve head portion 12 due to a pressure difference between a pressure (negative pressure) in the oil mist separator 1 to which an intake negative pressure is applied and a pressure in an interior of the engine. Accordingly, the check valve 10 is allowed to primarily operate in accordance with a relationship of the difference between the downward forces (F1+F2) and the upward forces (F3+F4).

Here, the force F1 due to an own weight of the check valve 10 is constant, the force F2 due to the gravitational force of the oil and the force F3 due to the buoyant force vary in accordance with a height of an oil level 14, and the force F4 varies in accordance with the pressure difference. Accordingly, the check valve 10 is allowed to operate in accordance with the oil level height and the pressure difference.

FIG. 5(A) is an explanatory view showing an operating state of the check valve 10 in accordance with the oil level height and the pressure difference. In FIG. 5(A), a check valve "closed" region is a region in which the check valve 10 is in the closed state in which the check valve 10 is in the uppermost position, and a check valve "open" region is a region in which the check valve 10 is in a state in which the check valve 10 is located below the valve closed position (see FIG. 2, FIG. 3).

In an engine stop condition, the oil in the oil drain pipe 5 is finally completely discharged through the auxiliary oil discharge passages 9. Therefore, the force F2 and the force F3 are not generated and the intake negative pressure is not applied to the oil mist separator, so that the force F4 due to the pressure difference also is not generated. Accordingly, the check valve 10 is brought into the valve open state in which the check valve 10 is located in the lowermost position by the force F1 due to the own weight.

When an operation of the internal combustion engine is started from the valve open state in such an engine stop condition, the pressure difference is increased due to the intake negative pressure acting on the oil mist separator. There is generated a pressure difference between the upper side and the lower side of the valve head portion 12 arranged in the drain pipe 5 with the fine clearance ΔD serving as the orifice, so that the force F4 upwardly directed exceeds the force F1 due to the own weight of the check valve 10. Therefore, the check valve 10 is quickly upwardly operated and brought into the closed state shown in FIG. 3 and FIG. 5(B). Further, when the check valve 10 closes the oil discharge hole 8, the force F4 due to the pressure difference acts on the valve body 11.

In such a valve closed state, when the oil is accumulated in the drain pipe 5, the height of the oil level 14 is raised, the downward force F2 due to the gravitational force of the oil and the upward force F3 due to the buoyant force act on the check valve 10. In a range al in which the oil level height is lower than the lower end of the valve head portion 12 in the valve closed state, the oil level 14 does not reach the valve head portion 12, and therefore, the buoyant force (force F3) is substantially not generated and the downward force F2 becomes large with the rise in the oil level height. Accordingly, although as shown in FIG. 5(A), the check valve 10 is likely to slightly easily open in accordance with the rise in the oil level height, the check valve 10 is not operated to be open as long as the pressure difference during the operation is not extremely small.

In a range α2 in which the oil level height position crosses the valve head portion 12 in the valve closed state, as the oil level height is raised, a volume of the valve head portion 12 submerged below the oil level becomes large. Therefore, an increment of the upward force F3 due to the buoyant force exceeds an increment of the downward force F2 due to the gravitational force of the oil. Accordingly, as shown in FIG. 5(A), the check valve 10 is unlikely to open in accordance with the rise in the oil level height, so that the check valve "closed" region is expanded. That is, the buoyant force of the valve head portion 12 serves to retain the oil to a suitable height in the drain pipe 5 in addition to the force F4 due to the pressure difference.

In a range α3 in which the oil level height position is higher than the valve head portion 12 in the valve closed state, the valve head portion 12 is already completely submerged below the oil level, and therefore, the force F3 due to the buoyant force is constant. Then, the downward force F2 due to the gravitational force of the oil is increased in accordance with increase in the oil level. Accordingly, as shown in FIG. 5(A), the check valve 10 is likely to readily open in accordance with the increase in the oil level. The check valve 10 opens in a stage in which a relationship of (F1+F2)>(F3+F4) with respect to the force F4 due to the pressure difference is satisfied.

In an actual engine operating condition, a variation in the above-described pressure difference also occurs due to influence of intake pulsation, etc. in addition to a variation in the oil level height which is caused due to the oil discharged from the oil mist separator 1. In a state in which a certain amount of the oil is accumulated in the drain pipe 5, a changeover between the check valve "open" region and the check valve "closed" region frequently occurs so that the opening operation and the closing operation of the check valve 10 are repeated.

Figure 5:
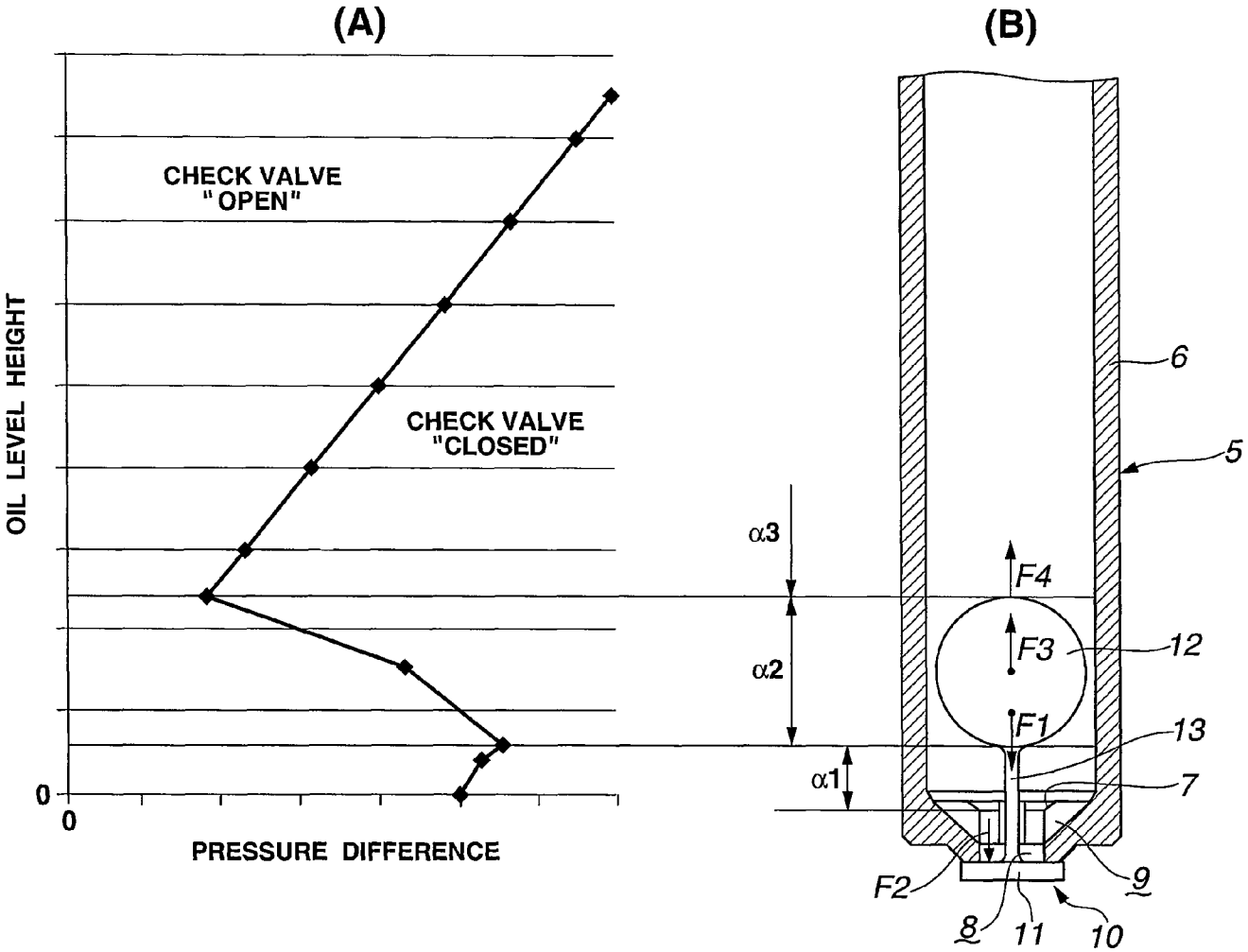
FIG. 5 is an explanatory diagram showing a characteristic diagram (A) showing an operating characteristic of the check valve in response to oil level height and pressure difference, and a sectional view (B) of an essential part of the drain pipe in comparison with each other.

Although in FIG. 5, the axis of abscissa shows pressure difference, the force F4 upwardly acting on the valve head portion 12 through the fine clearance ΔD as the orifice is varied depending on a flow rate of the blow-by gas. Accordingly, for example, it is possible to set such that the check valve 10 is in the open state during idling in which an amount of the blow-by gas generated is small, and the check valve 10 is brought into the closed state in a high speed and high load side region in which an amount of the blow-by gas generated is large.

According to the present embodiment as described above, there is provided a simple structure in which the check valve 10 having the valve body 11 and the valve head portion 12 at both ends thereof is mounted to the oil discharge hole 8. However, in the engine operating condition, the opening operation and the closing operation of the check valve 10 are repeated in a state in which a small amount of oil remains in the drain pipe 5, so that the check valve 10 can be held in the substantially closed state and a backflow of the blow-by gas which flows from the interior of the engine through the oil discharge hole 8 can be suppressed. Accordingly, it is possible to prevent the blow-by gas from bringing or blowing the oil into the intake system.

Especially, the check valve 10 includes the valve head portion 12 fitted into the tubular portion 6 of the drain pipe 5 with the fine clearance ΔD, which is provided separately from the valve body 11 that opens and closes the oil discharge hole 8 from the outside of the oil discharge hole 8. The valve head portion 12 surely receives the force F4 due to the pressure difference. Therefore, for instance, when the engine stop condition in which the check valve 10 is in the open state is shifted to the engine operating condition, the check valve 10 is surely moved to the closed state. That is, it is possible to more stably attain the desired opening and closing operations based on the pressure difference and the oil level height.

Further, when the check valve 10 is opened based on the relationship between the oil level height and the pressure difference and the oil inside the drain pipe 5 is discharged (FIG. 2), the check valve 10 is likely to be immediately operated upwardly (in the closing direction) by the force F4 due to the pressure difference acting on the valve head portion 12 contrary to drop of the oil level height. As a result, the oil discharge hole 8 is quickly closed again. Accordingly, it is possible to surely suppress a backflow of the blow-by gas which flows from the interior of the engine and therefore a backflow of the oil.

Further, in the above embodiment, the valve head portion 12 has a spherical shape. With this configuration, even when the check valve 10 is inclined with respect to an axial direction thereof, a cross-sectional area of the passage formed by the fine clearance ΔD is not varied so that the above-described characteristic can be stable obtained.

In a case where the structure according to the above embodiment is applied, excessive accumulation of the oil inside the drain pipe 5 can be suppressed, and therefore, a length of the drain pipe 5 can be reduced. As a result, a size of the oil mist separator 1 can be restricted to thereby enhance mountability thereof and reduce a cost for distribution process by downsizing the product. Thus, it is possible to attain significant effects in practical use.

Furthermore, since a height of the drain pipe 5 can be restricted, a degree of freedom of layout can be increased. Accordingly, the structure according to the above embodiment can be applied to an oil mist separator with high efficiency (air flow resistance is large), and the drain pipe 5 can be added even in a case where a dimensional condition is severe.

Figure 6:
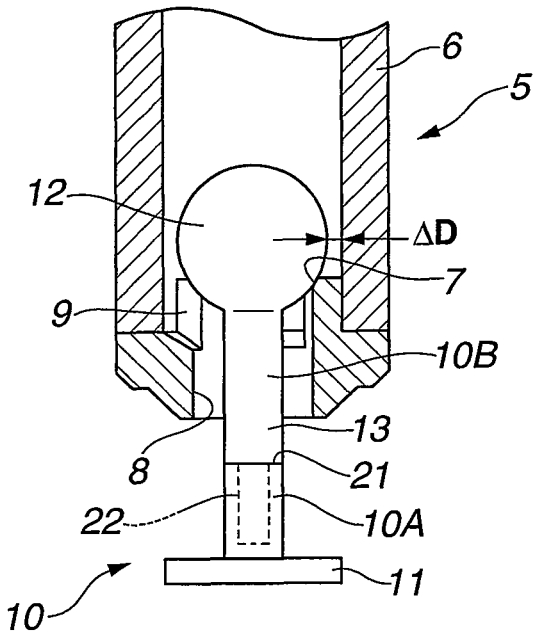
FIG. 6 is a sectional view of an essential part of a check valve according to a second embodiment of the present invention.

Next, by referring to FIG. 6, a second embodiment of the present invention will be explained. The basic shapes of the drain pipe 5 and the check valve 10 are similar to those of the above-described embodiment. The seat portion 7, the oil discharge hole 8, and the auxiliary oil discharge passages 9 are respectively formed on the lower end portion of the tubular portion 6 constituting the main body of the drain pipe 5. In this embodiment, three auxiliary oil discharge passages 9 are formed at equivalent intervals, so that the seat portion 7 is divided into substantially three arcuate portions.

Similarly to the above-described embodiment, the check valve 10 includes the disc-shaped valve body 11 that opens and closes the oil discharge hole 8 from the lower side, i.e., the outside of the oil discharge hole 8, the spherical valve head portion 12 fitted into the tubular portion 6 through the fine clearance ΔD, and the rod-shaped stem portion 13 that extends through the oil discharge hole 8 and connects the valve body 11 and the valve head portion 12 with each other.

In the present embodiment, a lower half portion 10A of the check valve 10 which includes the valve body 11 and a part of the stem portion 13 is made of an elastically deformable rubber. An upper half portion 10B of the check valve 10 which includes the valve head portion 12 and a part of the stem portion 13 is made of a rigid synthetic resin. The lower half portion 10A and the upper half portion 10B are integrally joined to each other on a mating surface 21 located in the middle of the stem portion 13. Further, in the stem portion 13, a central stem portion 22 having a small diameter which is made of a rigid synthetic resin extends below the mating surface 21. A part of the stem portion 13 of the lower half portion 10A made of the rubber is disposed on an outer periphery of the central stem portion 22.

For instance, after the upper half portion 10B including the valve head portion 12 is previously formed of the rigid synthetic resin, the upper half portion 10B is set in a mold for molding the lower half portion 10A. By molding the lower half portion 10A of the rubber material using the mold, the lower half portion 10A made of the rubber is vulcanized and bonded to the upper half portion 10B made of the synthetic resin.

According to the check valve 10 having such a configuration, after manufacturing the check valve 10 independently of the tubular portion 6, the check valve 10 is inserted and strongly pushed into the tubular portion 6, so that the disc-shaped valve body 11 is allowed to pass through the oil discharge hole 8 while being elastically deformed. Accordingly, the check valve 10 having the valve body 11 and the valve head portion 12 can be readily assembled in the oil discharge hole 8 without taking a half-split structure in a tip end portion of the tubular portion 6 or using a complicated step such as integrally joining the valve body 11 and the valve head portion 12 to each other after insertion of the stem portion 13. Thus, an assembly process of the oil mist separator 1 as a whole can be simplified.

Further, since the valve head portion 12 that moves in upward and downward directions inside the tubular portion 6 is made of the rigid synthetic resin, it is possible to reduce wear that is caused during a sliding movement of the check valve 10, as compared with the case of the check valve 10 made of a rubber as a whole.

Here, the valve head portion 12 of the above embodiment is a solid body molded of the rigid synthetic resin material, and therefore, a density thereof is higher than a density of the oil. In such a case, the valve head portion 12 does not serve as a float. However, when the valve head portion 12 is in the oil, the force F3 due to the buoyant force of the valve head portion 12 acts to cancel a part of the own weight of the check valve 10. In this point, similarly to the above first embodiment, the above-described characteristic as shown in FIG. 5 can be basically obtained in this embodiment.

More specifically, in this second embodiment, the drain pipe 5 and the check valve 10 are appropriate to a relatively small configuration, and an absolute weight of the whole check valve 10 is relatively small. Accordingly, the check valve 10 is readily closed by the upward force F4 generated by the blow-by gas flowing through the fine clearance ΔD, and then, the oil is stored until a certain oil level height due to the pressure difference without depending on the above-described function of the float.

In one specific embodiment, when an inner diameter of the tubular portion 6 is 6 mm, the check valve 10 having the valve head portion 12 with a diameter of 5 mm may be configured to have a weight of several grams. In the case of the check valve 10 having the thus small weight, the check valve 10 is operated sensitively responding to the upward force F4 generated by the blow-by gas flowing through the fine clearance ΔD. Accordingly, for instance, it is possible to set the check valve 10 to be in the open state during idling in which the amount of the blow-by gas generated is small, and set the check valve 10 to be brought into the closed state in a high speed and high load side region in which the amount of the blow-by gas generated is large.

Figure 7:
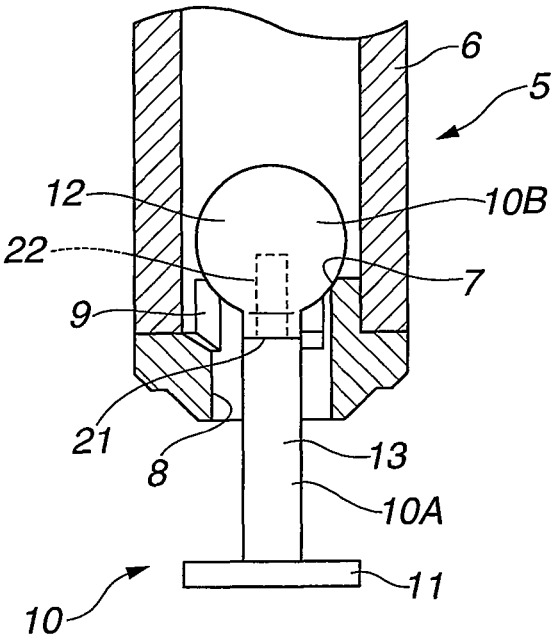
FIG. 7 is a sectional view of an essential part of a check valve according to a third embodiment of the present invention.

Next, FIG. 7 shows a third embodiment of the check valve 10. In this embodiment, contrary to the second embodiment, the lower half portion 10A of the check valve 10 which includes the valve body 11 and a part of the stem portion 13 is made of a rigid synthetic resin, and the upper half portion 10B of the check valve 10 which includes the valve head portion 12 and a part of the stem portion 13 is made of an elastically deformable rubber. In this case, the central shaft portion 22 is formed as a part of the lower half portion 10A made of the rigid synthetic resin, and extends from the mating surface 21 into an inside of the upper half portion 10B made of the rubber.

In the third embodiment as described above, since the valve head portion 12 is elastically deformable, the valve head portion 12 can be assembled into the oil discharge hole 8 by pressing the valve head portion 12 from the outside of the tubular portion 6 into the oil discharge hole 8 while deforming the valve head portion 12. Particularly, it is advantageous to carry out the insertion operation from the outside of the tubular portion 6, as compared with the second embodiment.

Figure 8:
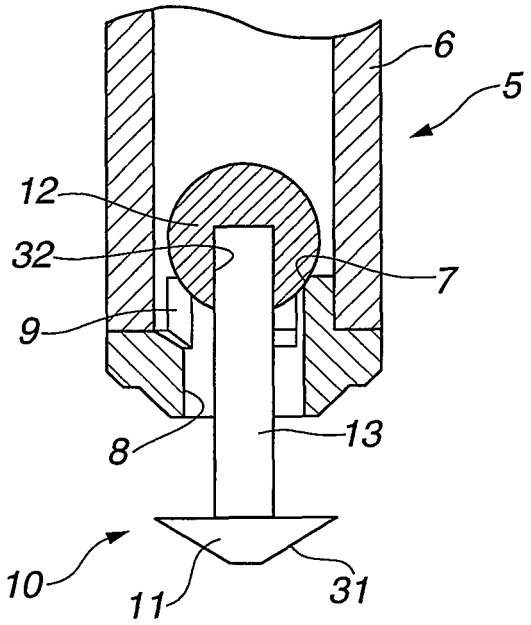
FIG. 8 is a sectional view of an essential part of a check valve according to a fourth embodiment of the present invention.
Figure 9:
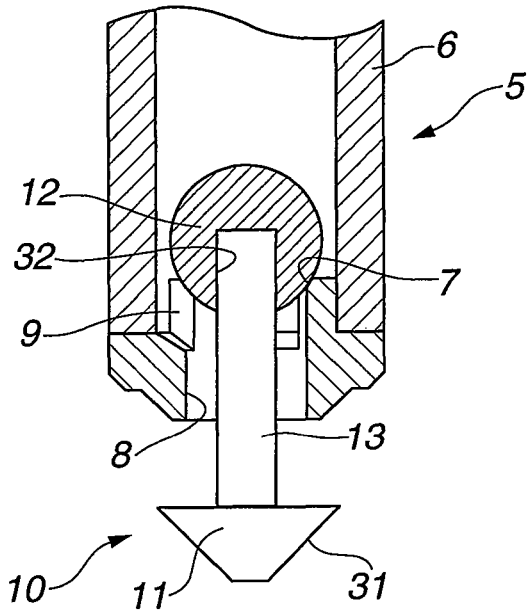
FIG. 9 is a sectional view of an essential part of a check valve according to a fifth embodiment of the present invention.

Next, FIG. 8 and FIG. 9 show a fourth embodiment of the check valve 10 and a fifth embodiment of the check valve 10, respectively. In these embodiments, a lower surface 31 of the valve body 11 to open and close the oil discharge hole 8 is formed into a conical surface. In the fourth embodiment, an inclination angle θ with respect to a central axis of the valve body 11 is 60° (60 degrees). In the fifth embodiment, the inclination angle θ is 45° (45 degrees).

In the illustrated embodiment, the whole check valve 10 is made of a rigid synthetic resin, and after the valve body 11 and the valve head portion 12 are separately molded, both the valve body 11 and the valve head portion 12 are assembled to form an integral body through the oil discharge hole 8. Specifically, the stem portion 13 is integrally formed with the valve body 11, and a mounting hole 32 into which an upper end of the stem portion 13 is fitted is provided in the spherical valve head portion 12 in the form of a recess. A distal end of the stem portion 13 is fixed into the mounting hole 32, for instance, by means of an adhesive in a state in which the stem portion 13 extends through the oil discharge hole 8.

In the configuration in which the lower surface 31 of the valve body 11 is formed into a conical surface, an oil droplet adhered to the lower surface 31 is likely to drop due to the inclination of the lower surface 31 and is prevented from growing to an excessively large droplet. Therefore, it is possible to suppress a change in opening and closing characteristics of the check valve 10 which is caused due to the weight of the oil droplet. Particularly, in the check valve 10 having a light weight of about several grams, a change in behavior of the check valve 10 which is caused due to the weight of the oil droplet becomes large. However, since the lower surface 31 is formed into an inclined surface, it is possible to prevent adhesion of a large oil droplet and thereby suppress an influence of the oil droplet on the behavior of the check valve 10.

Figure 10:
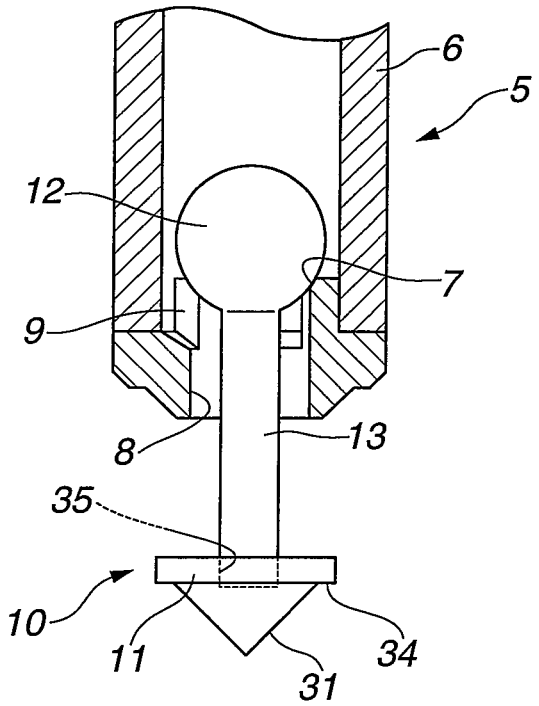
FIG. 10 is a sectional view of an essential part of a check valve according to a sixth embodiment of the present invention.

Next, FIG. 10 shows a sixth embodiment of the check valve 10 as a modification of the fourth and fifth embodiments. In this embodiment, the lower surface 31 of the valve body 11 is also formed into a conical surface, and a flat flange surface 34 having an annular shape is formed on a periphery of the conical surface. In such a configuration, similarly to the fourth and fifth embodiments described above, the conical surface serves to promote drop of the oil droplet so that a stable behavior of the check valve 10 can be stabilized.

Here, in the sixth embodiment, the whole check valve 10 is also formed of a rigid synthetic resin, and the stem portion 13 is integrally formed with the valve head portion 12, and a lower end of the stem portion 13 is fitted into a mounting hole 35 provided in the form of a recess on a side of the valve body 11, and is fixed thereto with an adhesive or the like.

Figure 11:
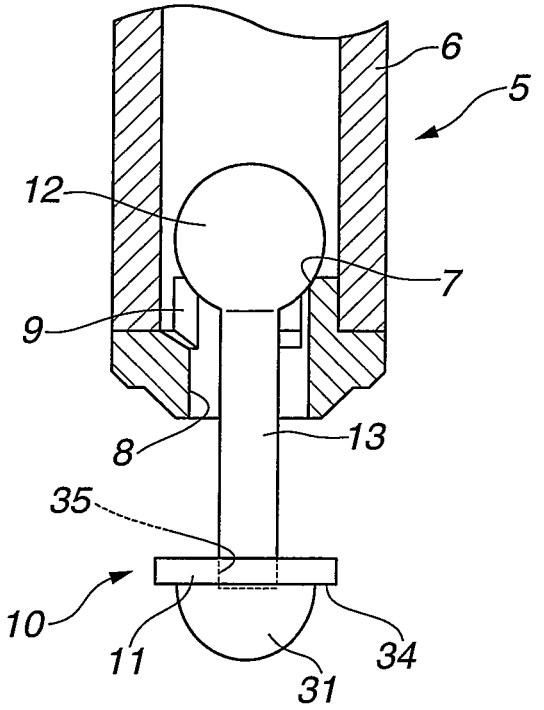
FIG. 11 is a sectional view of an essential part of a check valve according to a seventh embodiment of the present invention.

Further, FIG. 11 shows a seventh embodiment as a modification of the sixth embodiment. In this embodiment, the lower surface 31 of the valve body 11 is formed into not a conical surface having a linear profile but a curved surface, specifically, a hemispherical surface. In such a configuration, drop of the oil droplet can be promoted.

Figure 12:
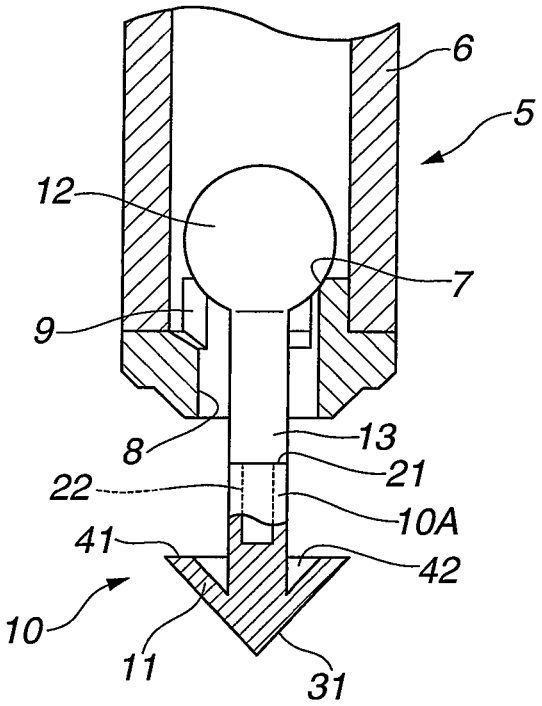
FIG. 12 is a sectional view of an essential part of a check valve according to an eighth embodiment of the present invention.

Next, FIG. 12 shows an eighth embodiment of the check valve 10. Similarly to the second embodiment, in this embodiment, the lower half portion 10A of the check valve 10 which includes the valve body 11 and a part of the stem portion 13 is formed of an elastically deformable rubber, and the upper half portion 10B of the check valve 10 which includes the valve head portion 12 and a part of the stem portion 13 is formed of a rigid synthetic resin. In addition, similarly to the fifth embodiment, the lower surface 31 of the valve body 11 is formed into a conical surface in order to promote drop of the oil droplet.

Here, a hollow portion 42 is formed in a central portion of a top surface of the valve body 11, that is, a sealing surface 41 that opens and closes the oil discharge hole 8, except for a peripheral portion of the sealing surface 41 along the conical surface of the valve body 11. In other words, the valve body 11 is formed into an umbrella shape having the substantially annular sealing surface 41.

With this configuration, when inserting the valve body 11 into the oil discharge hole 8 while deforming the valve body 11 as described above, the valve body 11 is likely to be slimly deformed and can be readily inserted into the oil discharge hole 8.

The invention claimed is:

1. An oil drain structure of an oil mist separator that is configured to separate oil mist from a blow-by gas of an internal combustion engine, and discharge the separated oil mist into an interior of the internal combustion engine while supplying the gas from which the oil mist is separated to an intake system, the oil drain structure comprising:

a drain pipe extending from the oil mist separator into the internal combustion engine, the drain pipe having an oil discharge hole extending through a lower end portion of the drain pipe along an axial direction of the drain pipe; and a check valve configured to open and close the oil discharge hole, the check valve comprising a valve body disposed below the lower end portion of the drain pipe, the valve body acting to open and close the oil discharge hole from a side of a lower end surface of the lower end portion of the drain pipe;

a valve head portion fitted into the drain pipe with a fine clearance as an orifice, the valve head portion being moveable in the axial direction of the drain pipe, the fine clearance being defined as a distance between the valve head portion and an inner wall surface of the drain pipe; and a stem portion extending through the oil discharge hole to connect the valve body and the valve head portion with each other, wherein the fine clearance is configured such that the separated oil mist is allowed to flow through the fine clearance even when the valve head portion is in a seated position, wherein the fine clearance is constant, regardless of a vertical position of the valve head portion in the axial direction of the drain pipe, and wherein the valve head portion is kept away from the inner wall surface of the drain pipe to maintain the fine clearance, regardless of the vertical position of the valve head portion in the axial direction of the drain pipe.

2. The oil drain structure of an oil mist separator as claimed in claim 1, wherein the drain pipe has a constant cross-sectional shape at least in a range in which the valve head portion is moveable.

3. The oil drain structure of an oil mist separator as claimed in claim 1, wherein a density of the valve head portion is lower than a density of oil.

4. The oil drain structure of an oil mist separator as claimed in claim 1, wherein an auxiliary oil discharge passage is formed in a seat portion located at an upper end of the oil discharge hole, the auxiliary oil discharge passage being formed such that the oil is discharged in a state in which the valve head portion is in the seated position.

5. The oil drain structure of an oil mist separator as claimed in claim 1, wherein the valve head portion is formed into a spherical shape.

6. The oil drain structure of an oil mist separator as claimed in claim 1, wherein one of the valve head portion and the valve body of the check valve is made of an elastically deformable rubber and the other of the valve head portion and the valve body of the check valve is made of a synthetic resin, and the one of the valve head portion and the valve body of the check valve is inserted into the oil discharge hole while being deformed.

7. The oil drain structure of an oil mist separator as claimed in claim 1, wherein a lower end surface of the check valve has a downwardly projecting conical surface or a downwardly projecting curved surface.

8. The oil drain structure of an oil mist separator as claimed in claim 1, wherein the fine clearance is set to be equal to or smaller than one-tenth of a radius of the drain pipe.

9. The oil drain structure of an oil mist separator as claimed in claim 1, wherein the tine clearance serves as the orifice such that the valve head portion is biased upward by a pressure difference between an upper side of the valve head portion and a lower side of the valve head portion to close the oil discharge hole via the valve body.

* * * * *